US009207044B2

(12) United States Patent
Brown

(10) Patent No.: US 9,207,044 B2
(45) Date of Patent: Dec. 8, 2015

(54) SIGHT ADAPTER FOR HANDHELD MORTAR SYSTEM

(76) Inventor: Blair Brown, Huntington Beach, CA (US)

( * ) Notice: Subject to any disclaimer, the term of this patent is extended or adjusted under 35 U.S.C. 154(b) by 259 days.

(21) Appl. No.: 13/590,930

(22) Filed: Aug. 21, 2012

(65) Prior Publication Data

US 2015/0233676 A1 Aug. 20, 2015

Related U.S. Application Data

(60) Provisional application No. 61/556,424, filed on Nov. 7, 2011.

(51) Int. Cl.
*F41G 1/50* (2006.01)
*F41F 1/06* (2006.01)
*F41G 3/06* (2006.01)

(52) U.S. Cl.
CPC ... *F41G 1/50* (2013.01); *F41F 1/06* (2013.01); *F41G 3/06* (2013.01)

(58) Field of Classification Search
CPC ..... F41G 1/50
USPC ..... 89/41.17, 37.05, 41.19, 200, 41.06; 42/105
See application file for complete search history.

(56) References Cited

U.S. PATENT DOCUMENTS

| | | | | | |
|---|---|---|---|---|---|
| 3,688,638 | A * | 9/1972 | Morris et al. | 89/41.11 |
| 3,710,675 | A * | 1/1973 | Asikainen | 89/41.17 |
| 4,026,190 | A * | 5/1977 | Blair | 89/41.17 |
| 4,292,880 | A * | 10/1981 | Lopez et al. | 89/1.815 |
| 4,548,122 | A * | 10/1985 | Hansson et al. | 89/37.05 |
| 4,961,369 | A * | 10/1990 | McGill | 89/41.11 |
| 6,059,573 | A * | 5/2000 | Patel | 434/16 |
| 6,237,463 | B1 * | 5/2001 | Grizzaffi | 89/41.17 |
| 6,289,782 | B1 * | 9/2001 | Watson, Jr. | 89/37.01 |
| 7,448,306 | B2 * | 11/2008 | Shipman et al. | 89/37.05 |
| 7,637,198 | B2 * | 12/2009 | De Villiers et al. | 89/41.17 |
| 7,934,652 | B2 * | 5/2011 | Hasselbring | 235/404 |
| 8,056,281 | B2 * | 11/2011 | Staley, III | 42/111 |
| 2011/0179689 | A1 * | 7/2011 | Blevins et al. | 42/111 |

* cited by examiner

*Primary Examiner* — Reginald Tillman, Jr.
(74) *Attorney, Agent, or Firm* — Buchalter Nemer

(57) ABSTRACT

A sight adapter for a handheld mortar that is secured directly to the mortar tube and provides a standardized mounting system for a weapon sight. The sight adaptor is for battlefield mortars not having a bipod. The sight adaptor of the current invention can be easily retrofit onto any handheld field mortar and includes a capability for determining projectile firing range and for correcting changes in the inclination of the mortar tube caused by rotation of the mortar tube on the ball joint of the base plate. The sight adapter a tilt sensor and provides for quick, easy and accurate targeting of a handheld mortar by comparing the target range determined from the sighting device with target range determined using projectile ballistic data and providing simple aim correction indicators to the mortarman.

10 Claims, 6 Drawing Sheets

SIGHT ADAPTER FOR HANDHELD MORTAR SYSTEM

RELATION TO OTHER PATENTS

Cross-Reference to Related Applications

This application claims the benefit of and is a continuation-in-part of U.S. Provisional Patent Application Ser. No. 61/556,424 filed on Nov. 7, 2011.

BACKGROUND AND SUMMARY OF THE INVENTION

1. Field of Invention

The present disclosure generally relates to apparatuses, systems and methods in the technical field of military mortar systems. More particularly, the present invention is in the technical field sighting devices for battlefield mortar without a bipod.

2. Related Art

Mortars have long been used in military conflicts for relatively short range engagements. Mortars can be particularly useful in close engagements because of their ability to launch projectiles in high, parabolic trajectory with a near vertical descent. The mortar can land bombs on nearby targets, including those behind obstacles or in fortifications, such as light vehicles behind hills or structures, or infantry in trenches. Mortars and their ammunition are generally much smaller and lighter than vehicle mounted artillery allowing for easy transport and use by individual combatants on the battlefield.

Mortars are generally constructed with a steel tube for firing a projectile. The tube is attached to a base plate often by using a ball joint. The based plate is used to support the tube and act to absorb recoil when fired. In many mortar designs, a bipod with a transverse support bar is mounted to the tube and used to support the tube in an upright position. The bipod also provides a support structure for a threaded azimuth adjustment bar and a sight that allow a mortarman to aim the weapon.

Although some mortar sights have been mounted to the tube, such as is disclosed in U.S. Pat. No. 2,478,898 and U.S. Pat. No. 6,568,118, conventional mortar sights are typically mounted to the bipod and are designed to aim at pre-positioned aiming stakes, instead of directly at the target. U.S. Pat. No. 2,478,898 and U.S. Pat. No. 6,568,118 are fully incorporated herein by reference. In a conventional mortar system, the sight is typically mounted to the left side of the traverse of the bipod. These sights are designed to rotate side to side (deflection) and up and down (elevation). Target data is input to the sight by turning the deflection and elevation knobs to the desired number. The whole weapon system is then shifted so the sight is pointed at the aiming poles at which point the bipod is adjusted to level the bubble levels on the sighting device.

Handheld mortars are generally smaller, lighter weight, and are carried onto the battlefield by soldiers and marines. Typically handheld mortars do not have either a bipod or an attached aiming sight. Sighting handheld mortar is achieved by holding the tube below the muzzle and placing the thumb in line with the tube. The mortarman then aims his thumb at the desired target. The angle of fire is then adjusted using a range scale on the firing handle and the mortarman continues to adjust his aim with subsequent firing. Proficiency in aiming a handheld mortar is gain only through repetition and practice in firing.

Even with significant practice, aiming a handheld mortar in a battlefield scenario can be difficult and often results in projectiles missing their target, use of valuable ammunition and time. Wind, temperature, moisture and other environmental variables all come into play when properly aiming a mortar. Additionally, projectile weight, propellant type and temperature, tube ware and other physical variable effect trajectory.

Handheld mortars are also subject to improper aiming based on any change in the deflection of the mortar. If a ball joint is used to mount the tube to the base plate, as is the case in most contemporary handheld mortar systems, as the tube is moved horizontally the arch of the ball in the ball joint will cause the elevation of the tube to rise or fall based on the curvature of the ball joint. In mortars with a bipod this can be corrected for with the use of a bubble level that is horizontally mounted on the sight. If there is any change in the elevation when moving the tube horizontally, you can simply turn a vertical adjustment screw until the level is again balanced. However, in a handheld mortar, because there is not bipod or sight, there is also not level to use for maintaining horizontal position.

Therefore a need exists for a sighting system for a handheld mortar that provides solution to the aforementioned deficiencies in the prior art. The present teachings provide such a system. In view of the foregoing background, the present invention overcomes the limitations of the prior art by providing for a sight adapter for handheld mortar systems. Therefore it is an object of this disclosure to provide a sight adapter that can be easily retrofit onto existing mortar systems by fastening directly to the launch tube of a handheld mortar.

In another aspect of this invention, provided is a Mil-Std-1913 Picatinny standardized mounting rail interface for easy attachment of an existing optical weapon sight.

In yet another aspect of the invention a sight adapter is provided with an electronic tilt sensor for detecting the angle of inclination and tilt of the handheld mortar tube relative to the ground and converting the data to a target distance indication and displaying such information for easy use by the mortarman.

It is yet another aspect of the invention to provide a novel curved bubble level associated with the launch tube for providing rapid information regarding the vertical position of the tube.

In another aspect of the invention, launch tube tilt data along with projectile, propellant and environmental data is used to calculate projectile flight distance.

In one further aspect of the invention, projectile flight distance is readily displayed to the mortarman for quick and convenient determination of tube angle vs. target range.

These and other objects, features and advantages in accordance with the present invention are provided. These aspects of the invention are not intended to be exclusive and other features, aspects, and advantages of the present invention will be readily apparent to those of ordinary skill in the art when read in conjunction with the following description, appended claims and accompanying drawings.

BRIEF DESCRIPTION OF THE DRAWINGS

Embodiments of the present disclosure will be more readily understood by reference to the following figures, in which like reference numbers and designations indicate like elements.

DETAILED DESCRIPTION OF THE PREFERRED EMBODIMENTS

The present invention will now be described more fully hereinafter with reference to the accompanying drawings in which preferred embodiments of the invention are shown. This invention may, however, can be embodied in many different forms and should not be construed as limited to the illustrated embodiments disclosed. Rather, these embodiments are provided so that this disclosure will be thorough and complete, and will fully convey the scope of the invention to those skilled in the art. Like numbers refer to like elements throughout. The sight adaptor will now be described in detail, with reference made to FIGS. 1-5.

The present invention provide for an apparatus, system and method in the technical field of military mortars. In broad embodiment, the present invention is a sight adapter that secures itself directly to the mortar tube and provides a standardized mounting system for a weapon sight. The advantages of the present invention include, without limitation, that it will improve the accuracy of a handheld mortar system. More particularly, the present invention is a sighting device adaptor for battlefield mortars not having a bipod for support. The sight adaptor of the current invention can be easily retrofit onto any handheld field mortar and includes a capability for determining projectile firing range and for correcting changes in the mortar tube elevation caused by rotation of the mortar tube on the ball joint of the base plate.

Figure 1A:
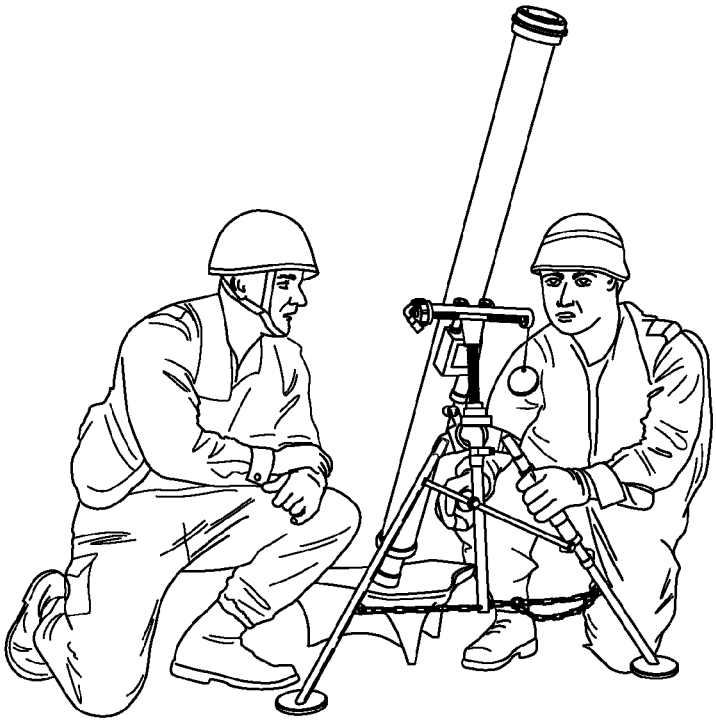
FIG. 1A is a representation of a traditional mortar with a bipod mount.
Figure 1B:
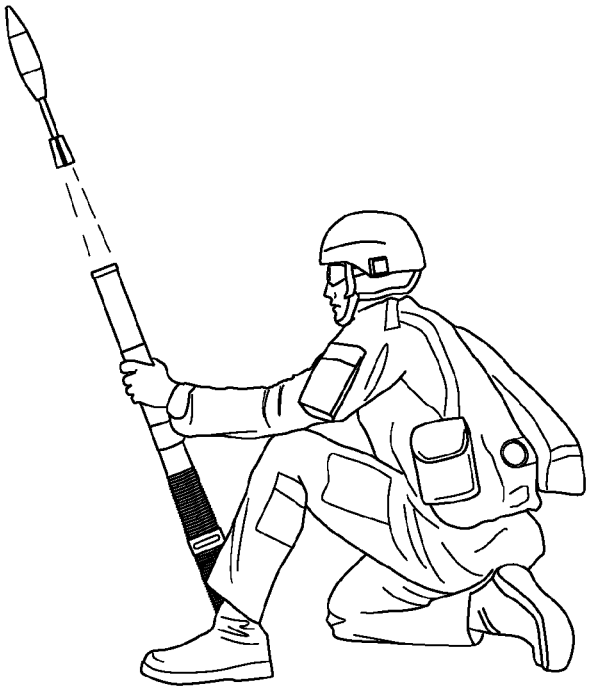
FIG. 1B is a representation of a handheld mortar without a bipod mount.

FIG. 1A shows a traditional mortar team, with the prior art mortar having a bipod, mortar tube, base plate and sighting scope. FIG. 1B demonstrates a traditional prior art handheld mortar without a bipod.

Figure 2:
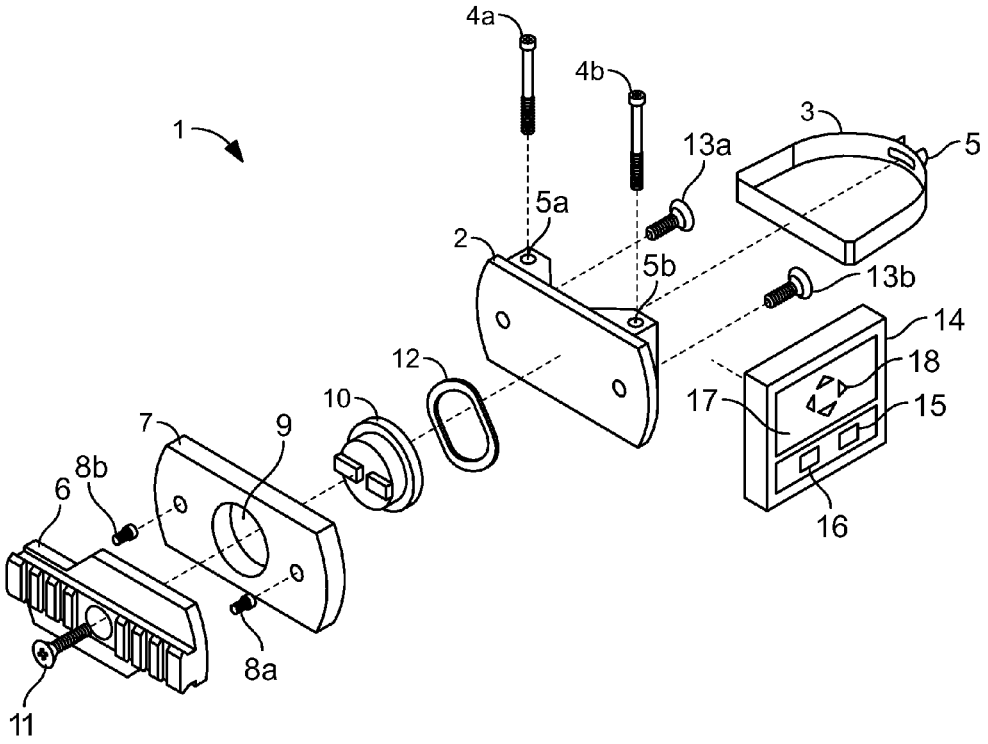
FIG. 2 is an exploded view of a sight adapter of the present invention.

Referring now to the invention in more detail. FIG. 2 provides an example of one embodiment of the current invention, showing the sight adaptor 1 in an exploded view. In further detail, FIG. 2 shows a sight adaptor having a mounting plate 2, with a mounting band 3 held in place with two band mount pins 4*a* and 4*b* firmly secured to the base plate 2 through pin mounting holes 5*a* and 5*b*. The band 3 is inserted behind the mounting pins 4*a* and 4*b* to attach the base plate 1 to the mortar tube. The band 3 is made of a flexible, but not stretchy material, such as steel. The band 3 may also be made of multiple solid pieces that pivot to clamp around the tube, or of a single solid piece around the tube and a device such as a screw to tighten the back plate 2 against the mortar tube. The band 3 can be tightened to secure the mount plate 1 to the tube of the mortar using a screw clamp 5. Alternatively, a tightening device such as a hose clamp or over center release may also be employed. However, it will be recognized by one skilled in the art that any know means of clamping can be used. In another alternative embodiment, the mount plate can be welded directly to the mortar tube for permanent attachment.

The sight adapter 1 includes standardized Picatinney mounting rail 6 that meets the MIL-STD-1913 standard. The mounting rail 6 provides a standardized mounting platform for attachment of an optical scope, laser or similar targeting device (not shown). The mounting rail 6 is attached to a front plate 7 using two screws 8*a* and 8*b*. The front plate incorporates a circular cut out 9 for accommodating and housing a pivot 10. The mounting rail 6 is secured to the sight adaptor 1 using a pivot screw 11 threaded through the pivot 10 and into the back plate 2. A wave washer 12 sits in the larger part of the cut out 9 in the housing and pushes on the lip of the pivot 10, keeping the front plate 7 sitting flat against the back plate 2 and providing enough friction to keep the front plate 7 from rotating during firing. The limit screws 13*a* and 13*b* ride in grooves in the front plate 7 and limit the distance the front plate 7 can pivot.

An electronic tilt sensor module 14 is mounted to the top of the back plate 2 such that the horizontal axis in both the X and Y direction of the tilt sensor is perpendicular to the center vertical axis of the mortar tube in both the X and Y directions respectively. The tilt sensor can be any off the shelf electronic tilt sensor, but is preferably the TruTILT™ dual axis electronics tilt sensor manufactured by The Fredricks Company. Preferably, the dual axis tilt sensor provides for the angle of inclination of the mortar tube from the horizontal plane and the off axis vertical tilt of the mortar tube resulting from a change in declination caused as the tube position is changed on ball joint of the base plate.

The tilt sensor module 14 includes two buttons 15 and 16 for in-putting data and for selecting options from pre-programmed menus. The menu includes items such as mortar type, weather conditions, etc., as discussed below. Also included is a display 17. Preferably, an LED display is used. The display 17 presents data to the user and includes directional arrows 18 used for adjustment of aim. The tilt sensor module is powered by standard batteries.

Figure 3A:
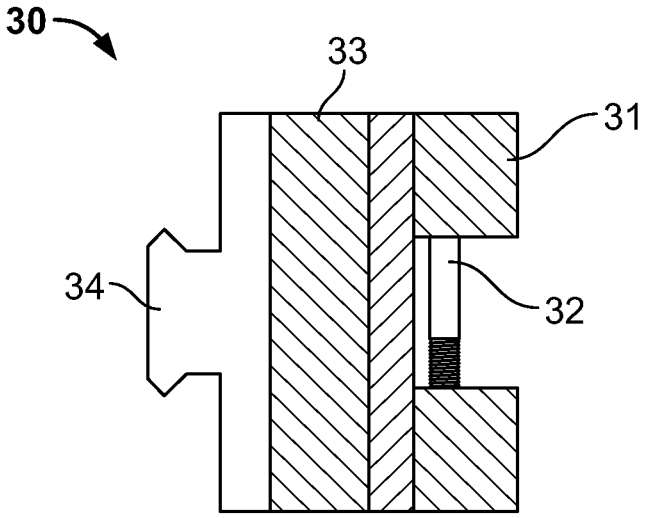
FIG. 3A is front view of the sight adapter of the present invention.
Figure 3B:
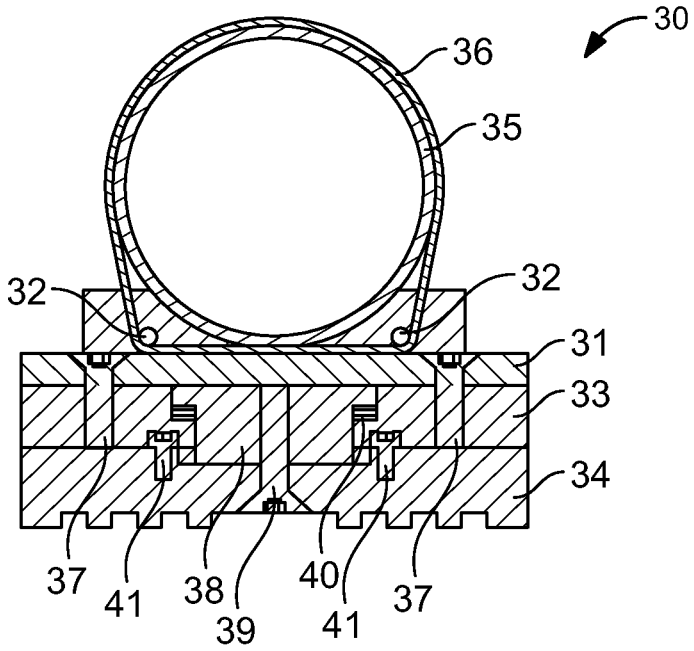
FIG. 3B is a top down cross section view of the present invention attached to the mortar tube.

In an alternative embodiment, in place of a dual axis tilt sensor, a single axis tilt sensor and a curved bubble level mounted perpendicular to the center axis of the launch tube can be used. The single axis tilt sensor provides for the angle of inclination of the mortar tube from the horizontal plane and the curved bubble level provides off axis vertical tilt of the mortar launch tube. The bubble level includes a graduated scale with small increments angular change to provide the user a visual indication of the off axis tilt of the tube. In the pure vertical position of the launch tube the bubble of the level will be centered. As the mortar tube tilts to one side or the other the bubble will remain in the highest position within the level but be aligned with off axis gradient mark, indicating the amount of off vertical axis tilt as the tube is moved Now referring to FIGS. 3A and 3B, shown is a front profile view of the sight adapter 30. FIG. 3B shows the adapter 30 secured to the mortar tube 35. The sight adapter 30 is comprised of a back plate 31 which contains screws 32 used to secure a mounting band 36 in mounting the sight adaptor to the mortar tube. The front plate 33 is attached to the back plate 31 by screws 37, and the front plate 33 secures the mounting rail 34 sitting flush against the front plate 33. The front plate 33 also houses the pivot 38, which is attached to the front plate 33 by pivot screw 39. The wave washer 40 sits in the larger part of the hole in the front plate 33 and pushes on the lip of the pivot 38, keeping the front plate 33 sitting flat against the rail body 34 and providing enough friction to keep the front plate 33 from rotating during firing. The two limit screws 41 ride in grooves in the rail body 34 and limit the distance the front plate 33 can pivot.

Figure 4A:
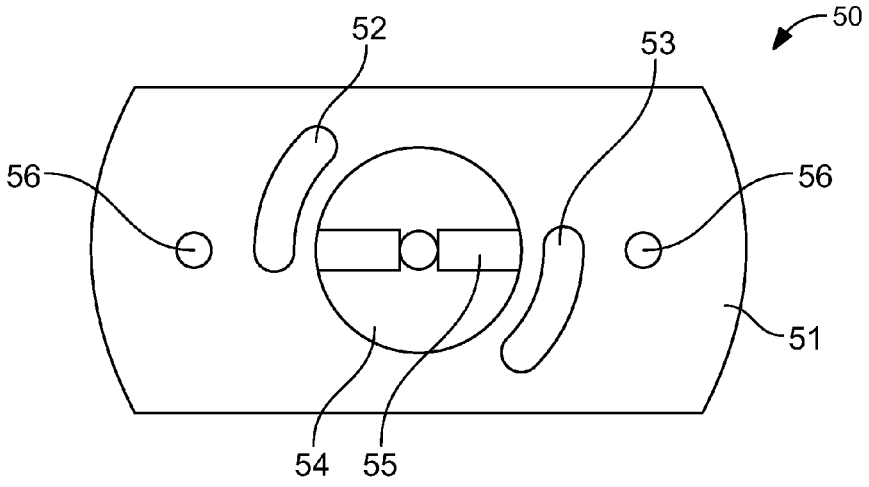
FIG. 4A is a front view of the internal rotation plate of a sight adapter of the present invention.
Figure 4B:
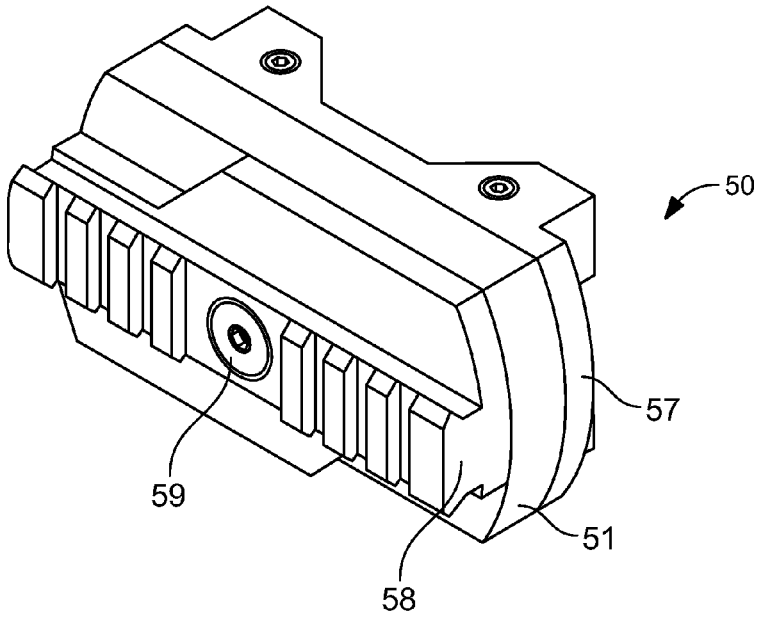
FIG. 4B is an isometric view of the sight adapter of the present invention.

In further detail, referring now to FIGS. 4A and 4B, the sight adapter 50 consists of a front plate 51 having grooves 52 and 53 in which the limit screws ride, thus limiting the sight adapter's 50 range of motion. The pivot 54 has a raised key 55 which indexes it to the front plate, causing them to rotate together. Screw holes 56 are provided in the front plate 51 for mounting the front plate 51 to the back plate 57. The rail 58 is secured using a pivot screw 59 threaded thought the pivot 54 and front plate 51.

Figure 5:
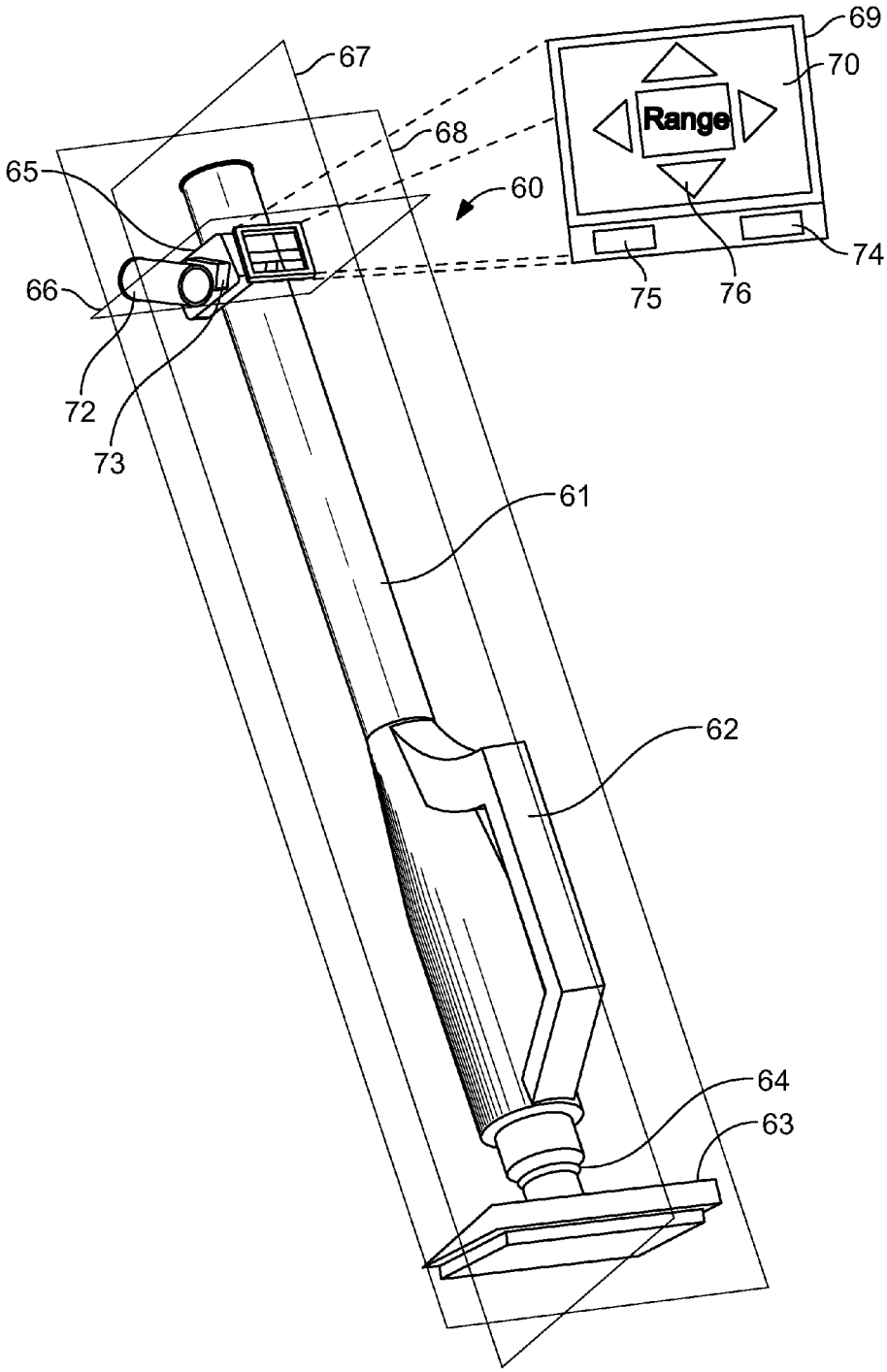
FIG. 5 is a perspective view of the sight adapter of the present invention mounted to the mortar tube and focusing on the display.

Now with reference to FIG. 5, FIG. 5 shows a handheld mortar 60 having a launch tube 61, a grip 62, and base plate 63. The tube 61 is mounted to the base plate 63 by a ball joint 64. The sight adaptor 65 of the present invention is mounted to the tube 61 as discussed above. When mounting the X axis 66 and Y axis (not shown) of the tilt sensor module 69 are aligned with the X axis 67 and Y axis 68 of the tube. This provides for accurate measurement of the deflection and elevation during firing. The tilt sensor module 69 includes an LED display 70 and data input buttons 74 and 75. An optical or laser scope 72 is mounted to the rail 73.

The tilt sensor module 69 is associated with a microprocessor (not show) having an integrated memory (also not shown) and is programming with ballistic data, an algorithm coded routine and a look up table with range data values. The microprocessor is preferably an ASIC type with programming that allows the user to input or select from pre-programmed menu options the mortar projectile weight and propellant profiles, simple weather condition such as wind speed and direction, and other variable that may impact ballistic trajectory of the projectile. The data can be input using a data input button 74, which allows the mortarman to scroll through input options, and an accept button 75 on the face of the tilt sensor module 69. The accept button is depressed to enter the selected data. The tilt sensor provides information on the mortar tube angle for the horizontal and vertical plain to the microprocessor. The microprocessor compares the variable information input by the mortarman and the horizontal and vertical tilt of the mortar tube and calculates the distance the projectile will travel. The tilt sensor module 69 includes a display 70 for providing information to the gunner. The ballistic range is the displayed on the LED screen 70 associated with the tilt sensor 69. The display 70 may also incorporate up, down, left right arrow indicators 76 that are highlighted to assist the mortarman in adjusting the direction of the mortar tube to the target. Alternatively, a voice module (not shown) can be used instead of or in conjunction with an LED display to provide audible feedback and information to the mortarman.

The microprocessor is pre-program with data for various projectile types, each projectile type will have predefined weight and propellant profiles and have a standard ballistic ranges corresponding to various angles of inclination. Also pre-programmed is an algorithm that calculates ballistic range based factoring wind speed, direction and other relevant variable values. The algorithm generates look up table of values and associate them with ballistic ranges calculated using degree of inclination, degree of off axis tilt, mortar type, wind data, etc. and store the values in memory.

Figure 6:
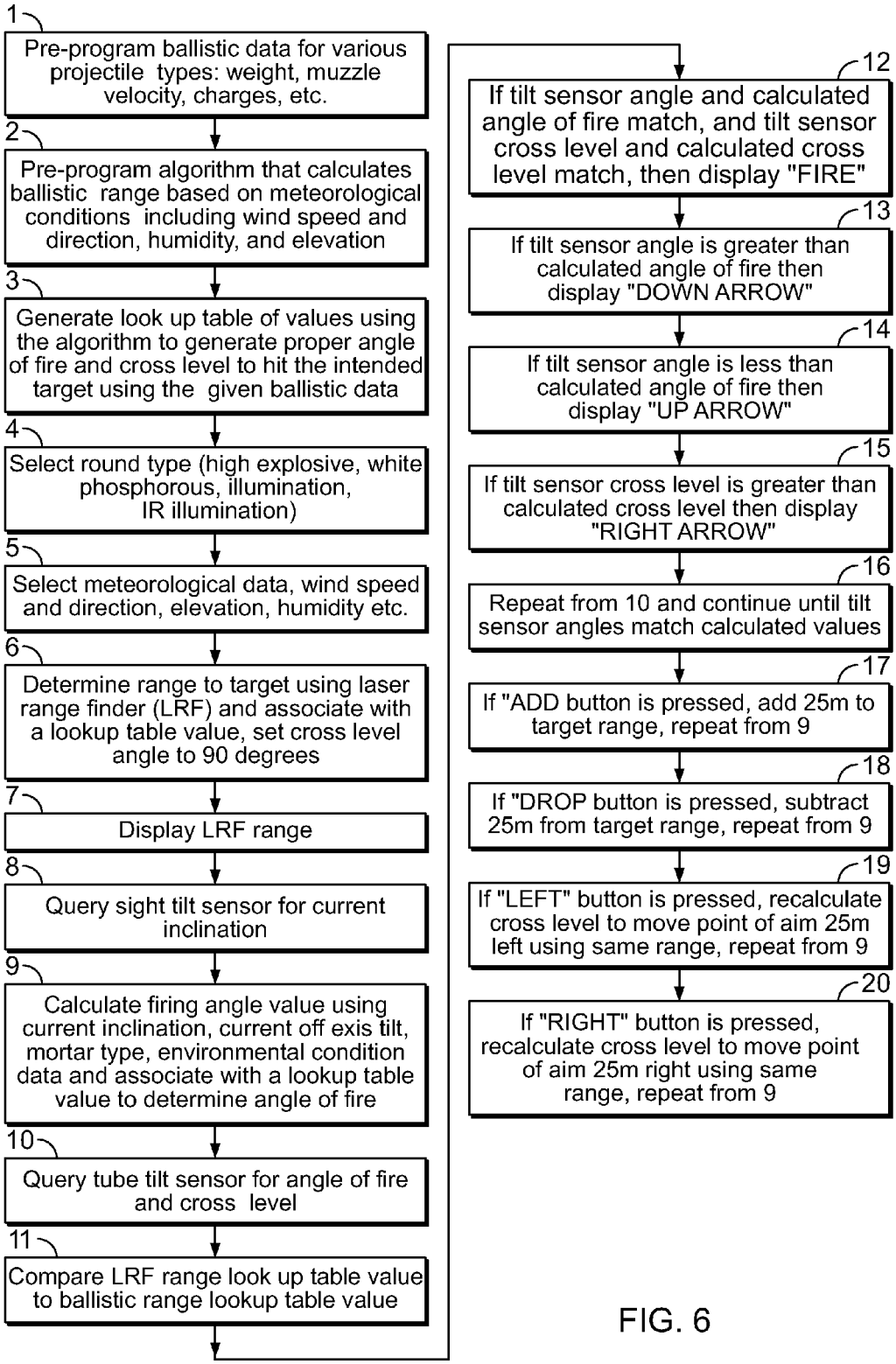
FIG. 6 is a flow chart demonstrating one embodiment of the logic of the current invention.

One embodiment of the logic used in the system is disclosed in FIG. 6. In box 1, various information that will effect the ballistic profile of a projectiles is pre-programmed into the ASIC with an associated memory of the system. As one of ordinary skill will appreciate, any well know microcontroller with a EEPROM memory can be used to control the operations of the system.

At step two, also preprogrammed into the routine is the algorithm that calculates ballistic range based factoring meteorological conditions such as wind speed and direction, humidity, and elevation. At step three, look up table values using the algorithm and preprogrammed data generate proper angle of fire and cross level to the intended target using the given ballistic data. Many know formulas for ballistics calculations exist and can be used in developing the algorithm.

At step 4 the mortar type is selected. Selection is done by using the input buttons of the tilt sensor module. Specific information regarding each mortar type, such as weight, charge and propellant are already loaded into the program. So, when the user selects a particular mortar type the mortar profile data is available. Other data categories such as round type and desired charge may be input manually.

In box 5, wind speed, direction and other relevant meteorological variable values are selected. The data can be meteorological data, such as temperature, humidity, elevation and wind speed and direction data. This data may be input manually through the input buttons or through sensors built into the sight adaptor. Selections can be made by scrolling though menu options using the system input buttons or they can be input into the system via other know wireless on wired connection with meteorological sensors. Alternatively, the input may come from a smartphone that has access to meteorological data via a telecommunications system.

In box 6, a determination of the range to target using a laser range finder (LRF) is made and associated with a lookup table value. The LRF can be any standard LRF that is attached to the adaptor rail. The LRF transfers range data to the microcontroller using a USB cable or a wireless connection.

Then, in box 7, the LRF range data is displayed on the LED display of the tilt sensor module.

At box 8, the tilt sensor is queried for current inclination and off axis tilt angle data.

At box 9, ballistic range value is calculated using current inclination angles, current off axis tilt angles, mortar type, wind and variable data and associate with a lookup table value.

At box 10, the tilt sensor is queried for the angle of fire, which is the angle of the tube from horizontal, and the cross level, which is the amount of tilt resulting from off center alignment.

At 11, the LRF range look up table value is compared to the ballistic range lookup table value.

Then at 12, if the tilt sensor angle and calculated angle of fire match, and tilt sensor cross level and calculated cross level match, then the micro controller sends the command to display "FIRE" on the display of the tilt sensor module.

At box 13, if the LRF range value is greater than the calculated ballistic range value the microcontroller sends the command to display the "DOWN ARROW".

At 14, if LRF range value is less than ballistic range value then, the microcontroller sends the command to display "UP ARROW".

At 14, if the off axis tilt component of ballistic range value is greater than vertical then at 15 the microcontroller sends the command to display "RIGHT ARROW", or if the off axis tilt component of ballistic range value of less than vertical then the microcontroller sends the command to display "LEFT ARROW".

At 16, this routine is repeated from 10 and the system continues to compare tilt sensor value and ballistic range value until they match. To clear data and start a new fire mission, the gunner can press and hold the "enter" button.

At 17, if "ADD" button is pressed, add 25 m to target range, repeat from 9.

At 18, if "DROP" button is pressed, subtract 25 m from target range, repeat from 9.

At 19, if "LEFT" button is pressed, recalculate cross level to move point of aim 25*m* left using same range, repeat from 9.

At 20, if "RIGHT" button is pressed, recalculate cross level to move point of aim 25*m* right using same range, repeat from 9.

The components of the sight adaptor can be constructed from any suitable sturdy non-brittle, temperature resistant material that can withstand battlefield conditions, including high grade, temperature resistant plastic, ceramic, cast or milled metal such as aluminum, or carbon fiber. Preferably, the adaptor is constructed light weight plastic that can withstand high temperatures and blunt impact.

While the above description of the invention enables one of ordinary skill to make and use what is considered presently to be the best mode thereof and has pointed out novel features of the present disclosure as applied to various embodiments, the skilled person will understand that various omissions, substitutions, combinations, permutations, changes and equivalents in the form and details of the present teachings illustrated may be made without departing from the scope of the present teachings.

Each claim set forth below is intended to encompass any apparatus or method that differs only insubstantially from the literal language of such claim, as long as such apparatus or method is not, in fact, an embodiment of the prior art. To this end, each described element in each claim should be construed as broadly as possible, and moreover should be understood to encompass any equivalent to such element insofar as possible without also encompassing the prior art. Furthermore, to the extent that the term "includes" is used in either the detailed description or the claims, such term is intended to be inclusive in a manner similar to the term "comprises"

The invention claimed is:

1. An adapter for mounting a target sight device to a handheld mortar, the mortar having a launch tube with a center axis extending the length of the tube, and a base plate for supporting the mortar during use, the adapter comprising:

a mounting structure for mounting the adaptor to the launch tube of the mortar in a manner whereby the mounting structure is reliably aligned with said center axis of the tube;

a rail structure for mounting a target sight device, wherein said rail structure is associated with a pivot assembly and said rail structure pivots relative to the mounting structure to accurately sight a target;

a curved bubble level mounted in a housing with a graduated scale indicative of the angle of tilt from vertical of the center axis of the mortar tube;

a tilt sensor whereby the tilt sensor is configured to be aligned with the central axis of the mortar tube and determines the angle of inclination of the central axis relative to the ground; and a data processing module, the data processing module comprised of a microcontroller having a memory and capable of executing machine readable instructions, a user interface whereby a user can selectively input data related to ballistic profile of a projectile, and a display for presentation of information to said user.

2. The adaptor of claim 1 whereby said tilt sensor is a dual axis tilt sensor and is further capable of determining the angle of tilt in two dimensions with respect to the center axis.

3. The adapter of claim 1 whereby said mounting structure is permanently mounted to the tube of a mortar.

4. The adapter of claim 1 whereby said mounting structure is releasably mounted to the tube of a mortar.

5. The adaptor of claim 1 wherein the data processing module is in communication with the tilt sensor and receives tilt sensor data and is in communication with the user interface and receives user input ballistic data, said microcontroller processes said tilt data and said ballistic data is used to calculate projectile trajectory distance.

6. The adaptor of claim 5, wherein the target sight device is a laser range finder capable of determining the distance to a target, and the processing module is in communication with said laser range finder to receive said distance to target data, the processing module is in communication with said tilt sensor to receive said tilt data and calculates a projectile firing distance; the processor module compares the laser range finder distance to the calculated projectile firing distance and provides a directional indicator output to the display until the distance to target data and the calculated projectile firing distance match.

7. An adapter for mounting a target sight device to a handheld mortar, the mortar having a launch tube with a center axis extending the length of the tube, and a base plate for supporting the mortar during use, the adapter comprising:

a mounting structure for mounting the adaptor to the launch tube of the mortar in a manner whereby the mounting structure is reliably aligned with said center axis of the tube;

a rail structure for mounting a target sight device, wherein said rail structure is associated with a pivot assembly and said rail structure pivots relative to the mounting structure to accurately sight a target;

a single axis tilt sensor whereby the tilt sensor is configured to be aligned with the central axis of the mortar tube and determines the angle of inclination to the central axis relative to the ground;

a curved bubble level mounted in a housing with a graduated scale indicative of the angle of tilt from vertical of the center of axis of the tube, the curved bubble level mounted perpendicular to a center axis of the launch tube; and a data processing module, the data processing module comprised of a microcontroller having a memory and capable of executing machine readable instructions, a user interface whereby a user can selectively input data related to ballistic profile of a projectile, and a display for presentation of information to said user.

8. An adapter for mounting a target sight device to a handheld mortar, the mortar having a launch tube with a center axis extending the length of the tube, and a base plate for supporting the mortar during use, the adapter comprising:

a mounting structure for mounting the adaptor to the launch tube of the mortar in a manner whereby the mounting structure is reliably aligned with said center axis of the tube;

a rail structure for mounting a target sight device, wherein the rail structure has a T-shaped cross-section and a series of ridges, said rail structure is associated with a pivot assembly and said rail structure pivots relative to the mounting structure to accurately sight a target;

a dual axis tilt sensor whereby the tilt sensor is configured to be aligned with the central axis of the mortar tube and determines the angle of inclination to the central axis relative to the ground and further determines the angle of tilt from vertical of the center axis of the mortar tube;

a data processing module, the data processing module comprising a microcontroller having a memory and capable of executing machine readable instructions, a user interface whereby a user can selectively input data related to projectile trajectory, and a display for presentation of information to said user, wherein the data processing module is in communication with the tilt sensor and receives tilt sensor data, the user interface and receives user input ballistic data, said microcontroller processes said tilt data and said ballistic data are used to calculate projectile trajectory distance and present the calculated distance on the display.

9. An adapter for mounting a target sight device to a handheld mortar, the mortar having a launch tube with a center axis extending the length of the tube, and a base plate for supporting the mortar during use, the adapter comprising:

a mounting structure for mounting the adaptor to the launch tube of the mortar in a manner whereby the mounting structure is reliably aligned with said center axis of the tube;

a rail structure that meets the MIL-STD-1913 standard for mounting a target sight device, wherein said rail structure is associated with a pivot assembly and said rail structure pivots relative to the mounting structure to accurately sight a target;

a dual axis tilt sensor whereby the tilt sensor is configured to be aligned with the central axis of the mortar tube and determines the angle of inclination to the central axis relative to the ground and further determines the angle of tilt from vertical of the center axis of the mortar tube;

a data processing module, the data processing module comprising a microcontroller having a memory and capable of executing machine readable instructions, a user interface whereby a user can selectively input ballistic data related to projectile trajectory, and a display for presentation of information to said user, wherein the data processing module is in communication with the tilt sensor and receives tilt sensor data, the user interface and receives user input data, said microcontroller processes said tilt data and said ballistic data to calculate and display projectile trajectory distance on the display;

wherein the target sight device is capable of determining the distance to a target, and the processing module is in communication with said laser sight to receive said distance to target data, the processing module is in communication with said tilt sensor to receive said tilt data and calculates a projectile firing distance; the processor module compares the laser sight distance to the calculated projectile firing distance and provides a directional indicator output to the display until the distance to target data and the calculated projectile firing distance match.

10. The adapter of claim 9 wherein the target sight device is a laser ranger finder.

* * * * *